United States Patent [19]

Carlqvist

[11] 4,307,569

[45] Dec. 29, 1981

[54] DOUBLE-ACTING FOUR-CYLINDER STIRLING ENGINE

[75] Inventor: Stig G. Carlqvist, Malmö, Sweden

[73] Assignee: CMC Aktiebolag, Malmö, Sweden

[21] Appl. No.: 28,019

[22] Filed: Apr. 6, 1979

[30] Foreign Application Priority Data

Oct. 9, 1978 [SE] Sweden ..... 7810529

[51] Int. Cl.[3] ..... F02G 1/04

[52] U.S. Cl. ..... 60/525

[58] Field of Search ..... 60/525

[56] References Cited

U.S. PATENT DOCUMENTS 2,817,950 12/1957 Weenen ..... 60/525

3,845,626 11/1974 Berntell ..... 60/525

3,898,841 8/1975 Kanzler ..... 60/525

3,940,934 3/1976 Hakansson ..... 60/525

*Primary Examiner*—Allen M. Ostrager

*Attorney, Agent, or Firm*—Beveridge, DeGrandi, Kline and Lunsford

[57] ABSTRACT

A double-acting Stirling engine has a central axis and four cylinders disposed along a straight line which intersects the central axis. Four regenerator/cooler units are disposed in a circle which is concentric with the axis. A tube system which connects the cylinders to the regenerator/cooler units includes first and second rings, both of which are formed of sets of tubes, and both of which are concentric with the central axis. The tubes in the first ring are connected to upper hot spaces of the cylinders; and, the tubes in the other ring are connected to the regenerators and to one of the tubes in the first ring.

9 Claims, 3 Drawing Figures

DOUBLE-ACTING FOUR-CYLINDER STIRLING ENGINE

Figure 1:
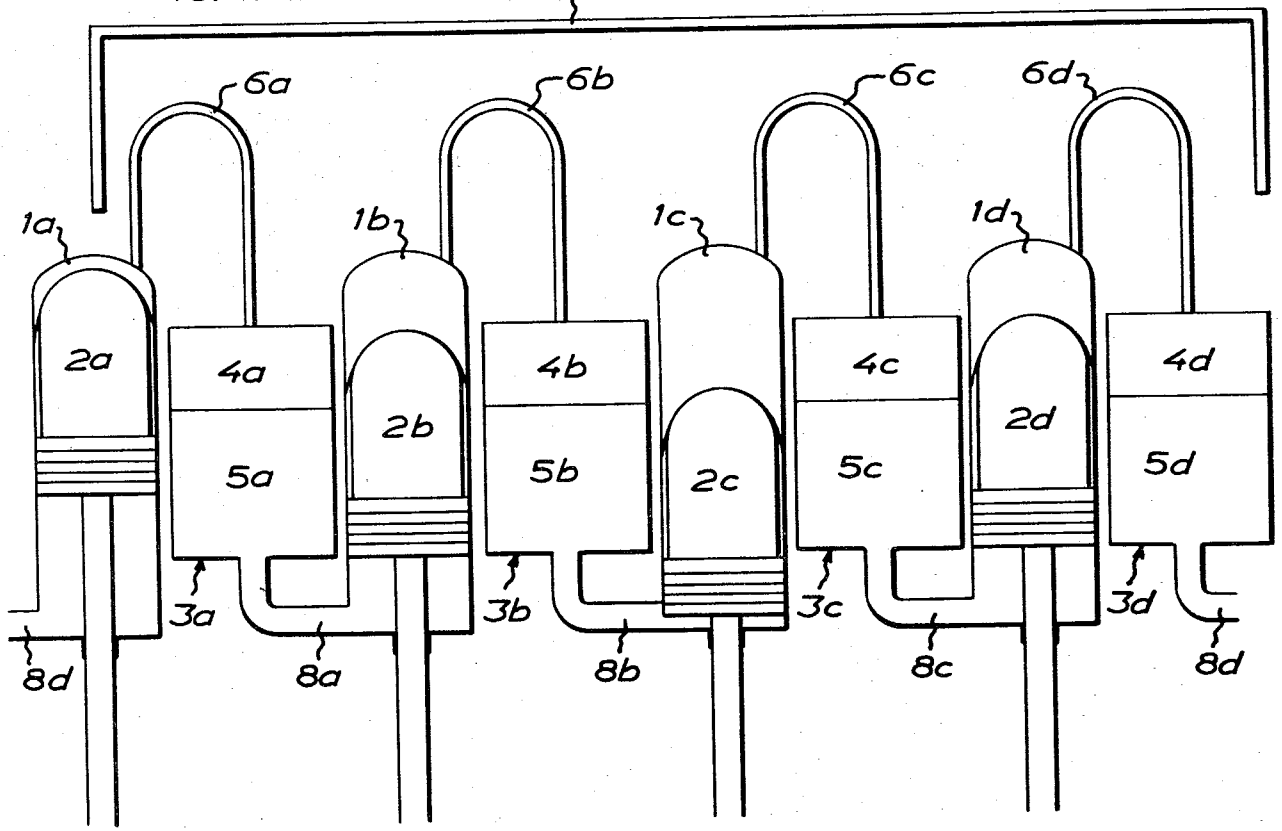
FIG. 1 PRIOR ART

This invention relates to a double-acting four-cylinder Stirling engine in which a rotationally symmetric combustor is provided for the heating of working gas; a piston arranged in each of the four cylinders of the engine divides the respective cylinder into an upper hot space and a lower cold space; each of the cylinders has a regenerator/cooler unit with an upper regenerator and a lower cooler, said cooler being in communication with the regenerator; the hot space of each cylinder is connected to the respective regenerator by means of a tube system which extends into the combustor; and the cold space of each cylinder is connected to a cooler in a regenerator/cooler unit associated with another cylinder.

In a double-acting Stirling engine the cylinder pistons move working gas forth and back between a hot side and a cold side and transfer mechanical work to a drive shaft. The pistons of a double-acting Stirling engine are thermodynamically coordinated and each piston simultaneously operates in two cycles, the hot upper side of a piston cooperating with the cold underside of the next piston. This implies that the Stirling engine must have at least three cylinders with cooperating pistons. The optimum effect is obtained with the use of 4–6 cylinders. The working gas is continuously moved forth and back between the hot space above the piston in one cylinder and the cold space beneath the piston in the next cylinder. Between these spaces the working gas flows through a heater disposed in a combustor, a regenerator and a cooler. Heat is supplied to the working gas in the heater of the combustor. The regenerator gives off heat to the working gas when said gas is moved from the cold side to the hot side, and stores heat when the working gas is moved in the opposite direction. The cooler takes up the heat produced during compression of the working gas. The temperature of the working gas will hereby be kept substantially constant on both the hot and the cold side.

A number of double-acting four-cylinder Stirling engines have been developed, which can be ranged in two main types of engines, viz. a first type in which the cylinders are disposed in a square arrangement with interleaved or exterior regenerator/cooler units, and a second type in which the cylinders are arranged in a row, following upon each other with the regenerator/-cooler units situated on one or both sides of the cylinder row.

The first type comprises so-called swash-plate type engines, so-called wobble-plate type engines, V-type engines and engines with double crankshafts coupled by means of gear wheels. A specific and complicated technology is applied to swash-plate and wobble-plate engines. These engine are recumbent engines of considerable length, which may often be disadvantageous, int. al. for reasons of space. In V-type engines the connection of the tubes interconnecting the cylinders and the regenerators with the combustor, and the location of the regenerators in relation to the cylinders will be complicated. Engines having double crankshafts are expensive and disadvantageous in view of mechanical friction losses. Moreover, in these engines there is a great risk of noise and wear of the gear wheels since these are exposed to very varying torques.

The second type comprises, on the one hand, engines in which each of the cylinders has a heater and a combustor and the cylinders on their cold side are connected to the associated cooler in such as way that every second connection is long and every second connection is short, and, on the other hand, engines in which every pair of cylinders has a common heater and combustor. In the engines of the second type there are thus required respectively four and two combustors per four-cylinder engine.

As mentioned in the foregoing, both of the above-mentioned main types of double-acting four-cylinder Stirling engines suffer from specific disadvantages and none of the above-mentioned Stirling engines satisfy in a simple manner the following requirements and desiderata:

1. The connections between the upper hot spaces of the cylinders and the regenerators must be such that a heat exchanger, heater, will have the appropriate area for heat transmission and for appropriate flow distribution of combustion gas and working gas without unnecessary dead volumes.

2. The connections between the lower cold spaces of the cylinders and the coolers must be short, i.e. their volume should be in a reasonable relation to the cylinder volume, and of equally large mutual lengths.

3. The four piston rods should be mechanically connected together by a single element which should be of simple construction based on known technique, and for instance be a conventional type crankshaft.

4. The four heater units, one for each cylinder, should together form a single rotationally symmetric combustor unit of the requisite volume for the combustion process.

5. A simple and compact construction of the cylinders and the regenerator/cooler units is desirable. It shall be easy to perform divisions between the hot and cold spaces of the cylinder block.

6. The friction losses of the mechanical power transmission must be kept low, for which reason the number of movable parts and bearing surfaces should be minimized.

The object of the present invention is to provide a double-acting four-cylinder Stirling engine in which the above disadvantages inherent in the known Stirling engines are eliminated and which satisfies the above-mentioned requirements and desiderata.

According to the invention, the upper hot spaces of the cylinders in a Stirling engine of the kind referred to in the introduction are each in communication with one circular cylinder collector extending over an angle of 90°, said cylinder collectors together forming a horizontal first ring. Each of the regenerators is in communication with a circular regenerator collector extending over an angle of 90°, said regenerator collectors together forming a horizontal second ring the axis of which coincides with that of the first ring and the diameter of which is larger than that of the first ring. The cylinders are arranged in a row, following upon each other along a straight line which intersects the common axes of the first and second ring at a right angle. The regenerator/cooler units are distributed over a circle the axis of which coincides with the common axes of the first and the second ring and the diameter of which is larger than that of the first ring.

Figure 2:
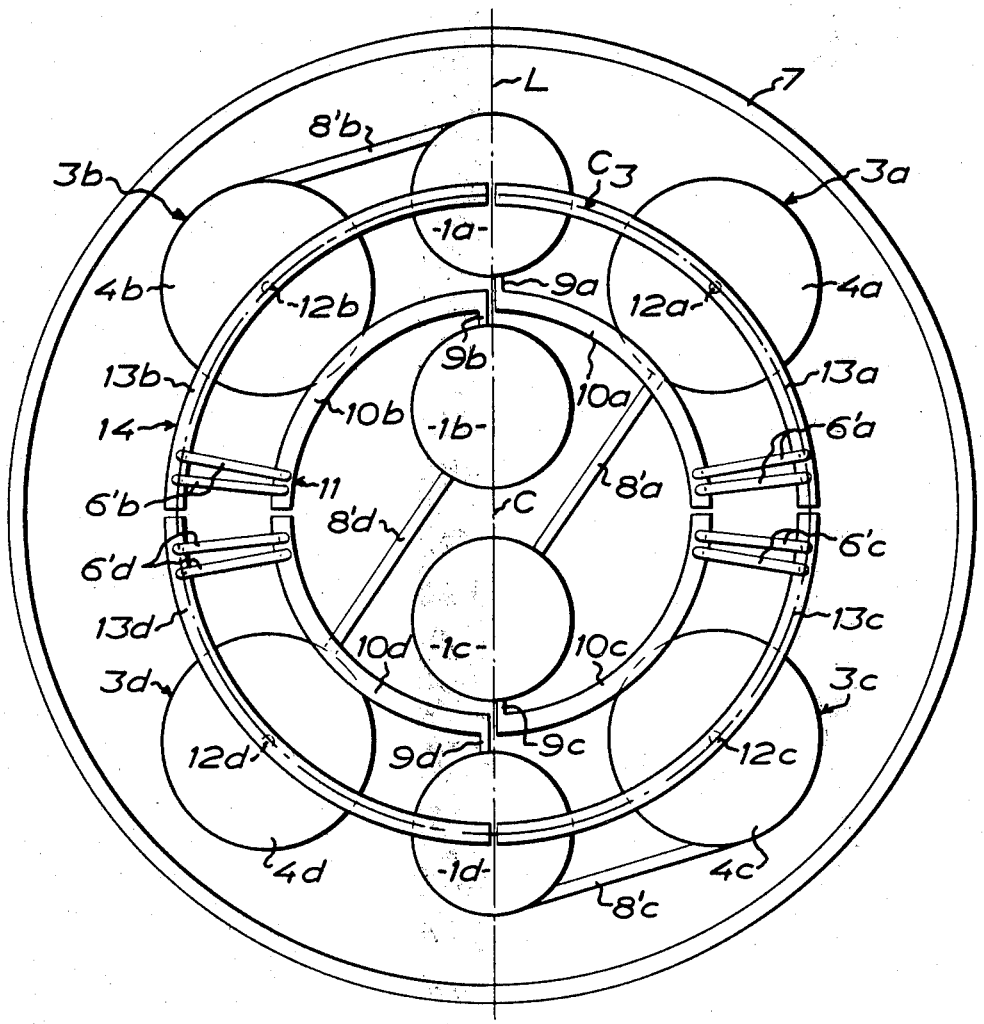
Figure 3:
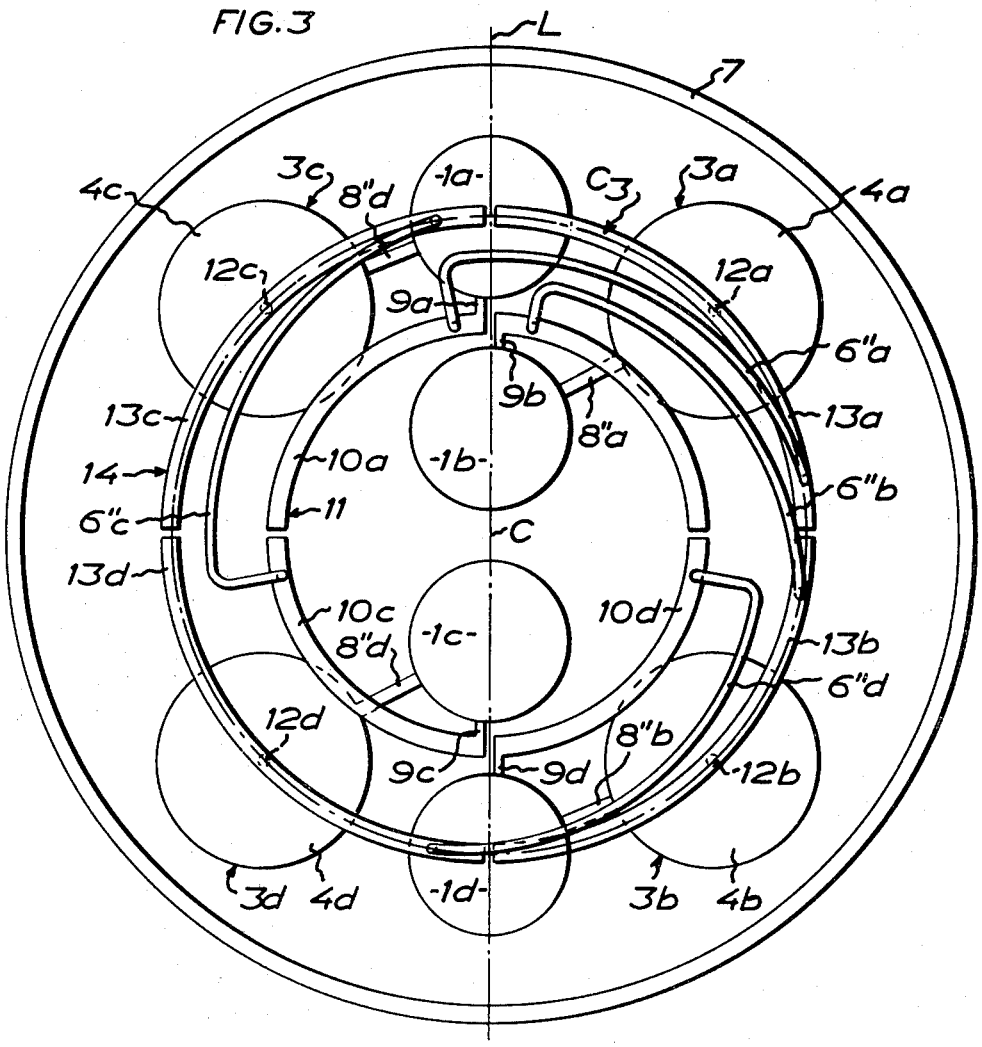

The invention will now be described in greater detail below with reference to the accompanying drawings in which:

FIG. 1 schematically shows the principle on which a double-acting four-cylinder Stirling engine functions;

FIG. 2 schematically shows a cylinder arrangement in a Stirling engine according to the invention, as seen from above; and FIG. 3 schematically shows another cylinder arrangement in a Stirling engine according to the invention, as seen from above.

Before the double-acting four-cylinder Stirling engine according to the present invention is described in greater detail the principle on which a double-acting four-cylinder Stirling engine functions will first be described with reference to FIG. 1 which shows four cylinders 1*a*, 1*b*, 1*c*, and 1*d* with pertaining pistons 2*a*, 2*b*, 2*c* and 2*d*. Associated with each cylinder 1*a*, 1*b*, 1*c*, 1*d* also is a regenerator/cooler unit 3*a*, 3*b*, 3*c* and 3*d* and which consists of an upper regenerator 4*a*, 4*b*, 4*c* and 4*d* and a lower cooler 5*a*, 5*b*, 5*c* and 5*d*, which are in communication with each other. Each cylinder 1*a*–1*d* above the respective piston 2*a*–2*d* has an upper hot space and below the respective piston 2*a*–2*d* a lower cold space.

Via a tube system 6*a*, 6*b*, 6*c* and 6*d* the hot spaces of the cylinders 1*a*, 1*b*, 1*c*, 1*d* are in communication with the respective regenerators 4*a*–4*d*. Each tube system 6*a*–6*d* forms a heat unit or heater and extends upwards into a combustor 7 in which a continuous combustion of combustion gas takes place. Via a tube 8*a*, 8*b*, 8*c* and 8*d* each cooler 5*a*, 5*b* 5*c* and 5*d* of each cylinder 1*a*, 1*b*, 1*c*, 1*d* is in communication with the cold space of the next cylinder 1*b*, 1*c*, 1*d* and 1*a*, respectively. The cylinders 1*a*–1*d*, the tube systems 6*a*–6*d*, the regenerator/cooler units 3*a*–3*d* and the tubes 8*a*–8*d* thus form a wholly closed system in which working gas, usually hydrogen or helium, is contained. The working gas is moved by the respective piston 2*a*–2*d* continuously forth and back between the hot space of a cylinder 1*a*–1*d* and the cold space of the next cylinder. In the heaters or tube systems 6*a*–6*d* heat is hereby supplied to the working gas. The regenerators 4*a*–4*d* give off heat to the working gas when said gas is moved from a cold space to a hot space, and store heat when the working gas is moved from a hot space to a cold space. The coolers 5*a*–5*d* take up the heat produced during the compression of the working gas. The temperature of the working gas will hereby be kept substantially constant on both the hot side and the cold side.

In the cylinder arrangement illustrated in FIG. 2 the four cylinders 1*a*–1*d* are arranged in a row, following upon each other along a straight line L, the distance between adjacent cylinders being equal. The hot space of each cylinder 1*a*, 1*b*, 1*c*, 1*d* is in communication via a tube length 9*a*, 9*b*, 9*c* and 9*d*, respectively, with one end of a circular cylinder collecting tube 10*a*, 10*b*, 10*c* and 10*d*, respectively, which extends over an angle of 90°. The cylinder collecting tubes 10*a*–10*d* are separated from each other and together form a horizontal first ring 11 situated approximately on a level with the upper surfaces of the cylinders 1*a*–1*d*. The axis C of said ring 11 is located midway between the two intermediary cylinders 1*b* and 1*c*. The radius of the ring is such that the cylinders 1*a*–1*d* are situated at the same distance from the ring 11.

The four regenerator/cooler units 3*a*–3*d* are uniformly distributed over a circle $C_3$ the axis of which coincides with the axis of the first ring 11 and the radius of which is larger than that of the first ring 11. Each regenerator 4*a*, 4*b*, 4c, 4*d* is in communication via a tube length 12*a*, 12*b*, 12*c* and 12*d*, respectively, with a circular regenerator collecting tube 13*a*, 13*b*, 13*c* and 13*d*, respectively, at the centre thereof, said regenerator collecting tubes each extending over an angle of 90°. The axes of the regenerator/cooler units 3*a*–3*d* are situated directly below the midpoints of the respective regenerator collecting tubes 13*a*–13*d*, the tube lengths 12*a*–12*d* extending vertically upwardly from the regenerators 4*a*–4*d* to the midpoints of the respective regenerator collecting tubes 13*a*–13*d*. The regenerator collecting tubes 13*a*–13*d* are separated from each other and together form a horizontal second ring 14 located above the respective regenerators 4*a*–4*d* and having the same radius as said circle $C_3$, the axis of said second ring 14 coinciding with the common axes of said circle $C_3$ and said first ring 11.

The cylinder collecting tubes 10*a*–10*d* and the regenerator collecting tubes 13*a*–13*d* are so arranged that the plane containing the above-mentioned straight line L and the above-mentioned common axis also contains the points of spacing between two pairs 10*a*, 10*c* and 10*b*, 10*d* of adjacent cylinder collecting tubes as well as two pairs 13*a*, 13*c* and 13*b*, 13*d* of adjacent regenerator collecting tubes.

Each cooler 5*a*, 5*b*, 5*c* and 5*d*, respectively, is in communication via a connecting tube 8'*a*, 8'*b*, 8'*c* and 8'*d*, with the cold space of the next cylinder 1*c*, 1*a*, 1*d* and 1*b*, respectively. The four connecting tubes 8'*a*–8'*d* are of equal length.

A series of closely spaced tubes 6'*a*, 6'*b*, 6'*c* and 6'*d*, respectively, which are bent into U-shape, extend between the cylinder collecting tube and the regenerator collecting tube in each pair 10*a*, 13*a*; 10*b*, 13*b*; 10*d*, 13*c* and 10*d*, 13*d* of cylinder collecting tubes and regenerator collecting tubes. Said tubes 6'*a*, 6'*b*, 6'*c* and 6'*d* extend upwards into the combustor 7 and only two tubes per pair are shown in FIG. 2. The limbs of the U-shaped tubes 6'*a*–6'*d* extend vertically upwards from the respective cylinder collecting tubes 10*a*–10*d* and regenerator collecting tubes 13*a*–13*d*, and their webs extend in radial direction.

The cylinder arrangement illustrated in FIG. 3 differs from that illustrated in FIG. 2 in that the regenerator/-cooler units 3*b* and 3*c* have changed places, that the cylinder collecting tubes 10*b* and 10*d* extend from the cylinders 1*b* and 1*d*, respectively, to the right (FIG. 3) instead of to the left (FIG. 2), that the cylinder collecting tubes 10*a* and 10*c* extend from the cylinders 1*a* and 1*c*, respectively, to the left (FIG. 3) instead of to the right (FIG. 2), and that the coolers 5*a*, 5*b*, 5*c* and 5*d* are coupled by means of connecting tubes 8''*a*, 8''*b*, 8''*c* and 8''*d*, respectively, to the cylinders 1*b*, 1*d*, 1*a* and 1*c*, respectively, (FIG. 3), instead of to the cylinders 1*c*, 1*a*, 1*d* and 1*b*, respectively (FIG. 2). Further, the arrangement illustrated in FIG. 3 differs from that illustrated in FIG. 2 in that the U-shaped tubes 6''*a*, 6''*b*, 6''*c*, 6''*d* (of which but one per pair is shown in FIG. 3) connecting the cylinder collecting tubes 10*a*–10*d* with the respective regenerator collecting tubes 13*a*–13*d* have their outlets to the respective regenerator collecting tubes 13*a*–13*d* offset through 90° in relation to their inlets from the respective cylinder collecting tubes 10*a*–10*d*. This thus requires tubes of a somewhat more complicated shape than that of the tubes 6'*a*–6'*d* in the cylinder arrangement illustrated in FIG. 2. The tubes 6'*a*–6'*d* are of such a simple shape that they can be made from ceramics, while the tubes 6''*a*–6''*d* are preferably made from metallic materials.

The cylinder arrangements illustrated in FIGS. 2 and 3 satisfy the requirements and desiderata placed on the function and performance of the double-acting four-cylinder Stirling engine. As will appear from FIGS. 2 and 3, the sequence of the cylinders, in which the thermodynamic cycle takes place, or "the firing order" in the arrangement according to FIG. 2 is a–b–d–c, and in the arrangement according to FIG. 3 it is a–c–d–b. These sequences allow the utilization of suitably shaped conventional crankshafts.

The cylinder arrangements illustrated in FIGS. 2 and 3 can be modified in a great many different ways by changing the sequence of the regenerators/cooler units 3*a*–3*d* over the circle $C_3$, by varying the extension of the cylinder collecting tubes 10*a*–10*d* from the respective cylinders 1*a*–1*d* to the right or to the left, and by connecting the coolers 5*a*–5*d* to the cylinders 1*a*–1*d* in another sequence. In this way, other "firing orders" can be realized, which also allow the utilization of suitably shaped conventional crankshafts.

What I claim and desire to secure by Letters Patent is:

1. A double-acting four cylinder Stirling engine, comprising, a rotationally symmetric combustor for heating a working gas;

said engine having four cylinders with pistons therein which divide each of the respective cylinders into an upper hot space and a lower cold space, a set of regenerator/cooler units each of which is associated with one of the cylinders and includes an upper regenerator and a lower cooler which are in communication with each other, a tube system located in the combustor and connecting the hot space of each cylinder with the regenerator of its associated regenerator/cooler unit, said tube system connecting the cold space of each cylinder with the cooler of a regenerator/cooler unit which is associated with another cyliner, the improvement wherein the tube system includes a horizontal first ring formed of a circular set of cylinder collecting tubes, each of which is in communication with the upper hot space of a cylinder, a horizontal second ring having a greater diameter than the first ring and being formed of a circular set of regenerator collecting tubes each of which is connected to one of the regenerators and to one of the cylinder collecting tubes, said first and second rings having a common axis, said engine cylinders being disposed along a straight line which intersects said common axis at a right angle, said regenerator/cooler units being disposed in a circle which has an axis coincident with said common axis and a diameter greater than that of the first ring.

2. An engine as claimed in claim 1 wherein the cylinders are spaced equal distances from said first ring.

3. An engine as claimed in claim 1 wherein adjacent cylinders are spaced equal distances apart.

4. An engine as claimed in any one of claims 1, 2 or 3 wherein the regenerators are uniformly distributed over said circle.

5. An engine as claimed in any one of claims 1, 2 or 3 wherein said circle and said second ring have the same diameters.

6. An engine as claimed in any one of claims 1, 2 or 3 wherein the cylinder collecting tubes have ends which are connected to the ends of the respective cylinder collecting tubes.

7. An engine as claimed in any one of claims 1, 2 or 3 wherein the respective regenerator collecting tubes have their midpoints connected to the regenerators.

8. An engine as claimed in any one of claims 1, 2 or 3 wherein a plane containing said straight line and the common axes of said first and said second ring also contain a separation gap between two pairs of adjacent cylinder collecting tubes.

9. An engine as claimed in any one of claims 1, 2 or 3 wherein a plane containing said straight line and the common axes of said first and said second ring also contains a separation gap between two pairs of adjacent regenerator collecting tubes.

* * * * *